United States Patent [19]

Yasuhira et al.

[11] 4,395,229

[45] Jul. 26, 1983

[54] DISCHARGE TYPE IGNITOR FOR OIL STOVE

[75] Inventors: Shuji Yasuhira, Tondabayashi; Shinichi Naka, Yao, both of Japan

[73] Assignee: Sharp Kabushiki Kaisha, Osaka, Japan

[21] Appl. No.: 247,250

[22] Filed: Mar. 25, 1981

[30] Foreign Application Priority Data

Jul. 22, 1980 [JP] Japan ..... 55-104103[U]

[51] Int. Cl.[3] ..... F23Q 3/00

[52] U.S. Cl. ..... 431/261; 431/71; 431/79; 431/298; 431/320

[58] Field of Search ..... 431/261, 79, 71, 298, 431/320, 344

[56] References Cited

U.S. PATENT DOCUMENTS

| | | | |
|---|---|---|---|
| 3,134,423 | 5/1964 | Smith | 431/261 X |
| 3,224,487 | 12/1965 | McInerney et al. | 431/79 |
| 3,301,308 | 1/1967 | Briggs | 431/79 |
| 3,437,414 | 4/1969 | Gorman | 431/79 |
| 4,167,389 | 9/1979 | Donnelly et al. | 431/79 |

FOREIGN PATENT DOCUMENTS

| | | | |
|---|---|---|---|
| 56-46928 | 4/1981 | Japan | 431/298 |
| 1489973 | 10/1977 | United Kingdom | 431/261 |

*Primary Examiner*—Edward G. Favors

*Attorney, Agent, or Firm*—Birch, Stewart, Kolasch & Birch

[57] ABSTRACT

An ignitor assembly for oil stoves is disclosed which includes an ignitor plug held in alignment with an exposed portion of a wick for firing the wick through the utilization of discharge originated from the ignitor plug. A light-sensitive element is disposed at a predetermined distance from the ignitor plug and in alignment with the exposed portion of the wick.

9 Claims, 8 Drawing Figures

Fig. 4a
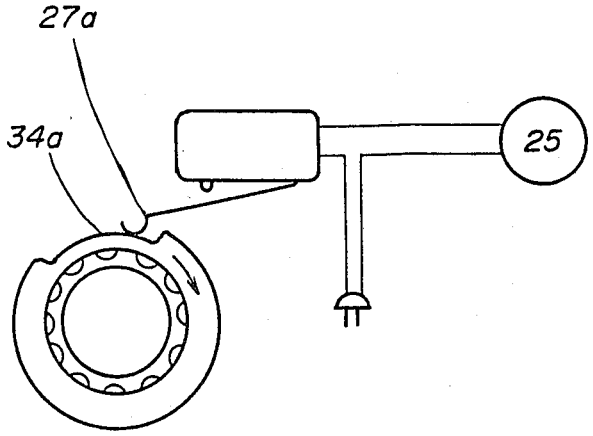
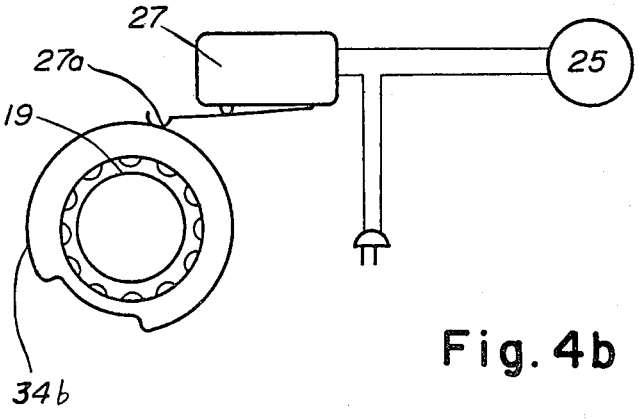
Fig. 4b

Fig. 6a
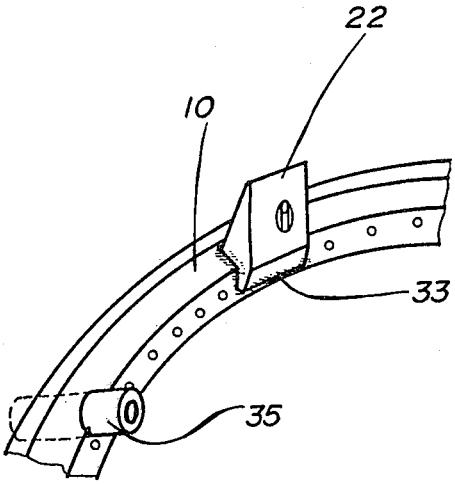
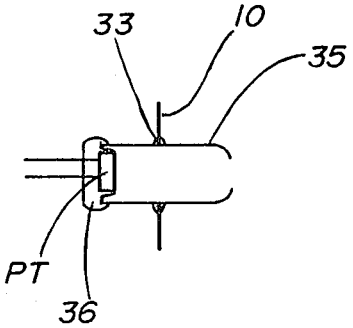
Fig. 6b

DISCHARGE TYPE IGNITOR FOR OIL STOVE

BACKGROUND OF THE INVENTION

This invention relates to an ignitor for a moving wick type oil stove and more particularly an improved ignitor utilizing discharge phenomenon for effecting the firing of the wick.

The conventional ignitors for use in oil stoves are such that they may fire the wick from inside an inner flame cylinder by forcing a heater into direct contact with the wick, or fire the wick from outside the periphery of the wick by means of a heater. Alternatively, the wick may be fired through an openable ignitor window outside the wick by forcing a heater into direct contact with the wick upon actuation of a push button or a knob. Still another way to fire the wick is the use of a pilot wick. However, these prior art devices demand high accuracy of machining and aligning of these components and result in a complexity of structure.

OBJECTS AND SUMMARY OF THE INVENTION

Accordingly, it is an object of the present invention to provide a new ignitor which takes advantage of discharge phenomenon for effective firing of a wick of an oil stove while enjoying the advantages of discharge firing schemes widely used with other fuel (liquid or gas) combustion devices.

Another object of the present invention is to provide an ignitor which not only exhibits a performance (with respect to firing speed, power consumption, etc) comparable with the conventional firing heater but also offers superior advantages over the conventional devices.

In accordance with an embodiment of the present invention, there is provided an ignitor assembly for oil stoves which includes an ignitor plug held in alignment with an exposed portion of a wick for firing the wick through the utilization of discharge originated from the ignitor plug. A light-sensitive element is disposed at a predetermined distance from the ignitor plug and in alignment with the exposed portion of the wick.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 4(*a*) and 4(*b*) are views for explanation of a microswitch and a cam plate;

FIGS. 6(*a*) and 6(*b*) are an enlarged perspective view of the essential part of the present invention and a view showing a light receiving tube.

DETAILED DESCRIPTION OF THE INVENTION

Figure 1:
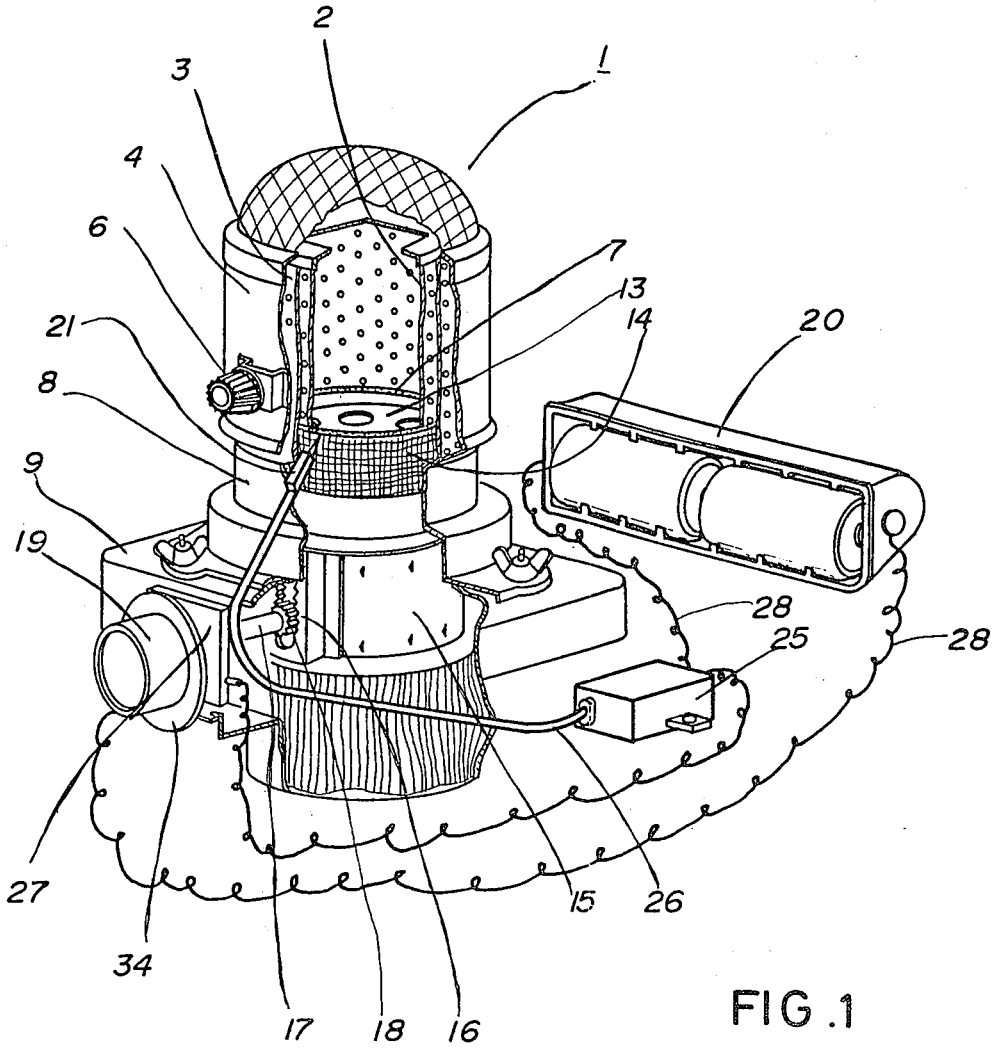
FIG. 1 is a perspective view of an essential part of an embodiment of the present invention.

The present invention will now be described in detail by way of a specific embodiment as shown in the accompanying drawings. Referring more particularly to FIG. 1, there is shown in a fragmentary exploded perspective view an oil stove with an ignitor assembly according to an embodiment of the present invention. A burner 1 generally includes an inner shell 2, an outer shell 3 and a cylindrical casing 4 all coaxial with a cross pin 5 (see FIG. 2), a burner handle 6, a perforated bottom plate 7, a coiled wire (not shown), etc. An inner wick cylinder 8 is seated on a fuel container 9 with its upper end receiving an outer wick ring 10 as seen from FIG. 2. An outer wick cylinder 11 has an upper end facing inwardly to constitute a burner mounting flange 12. The periphery of a wick top 13 is seated on the flange 12.

Figure 2:
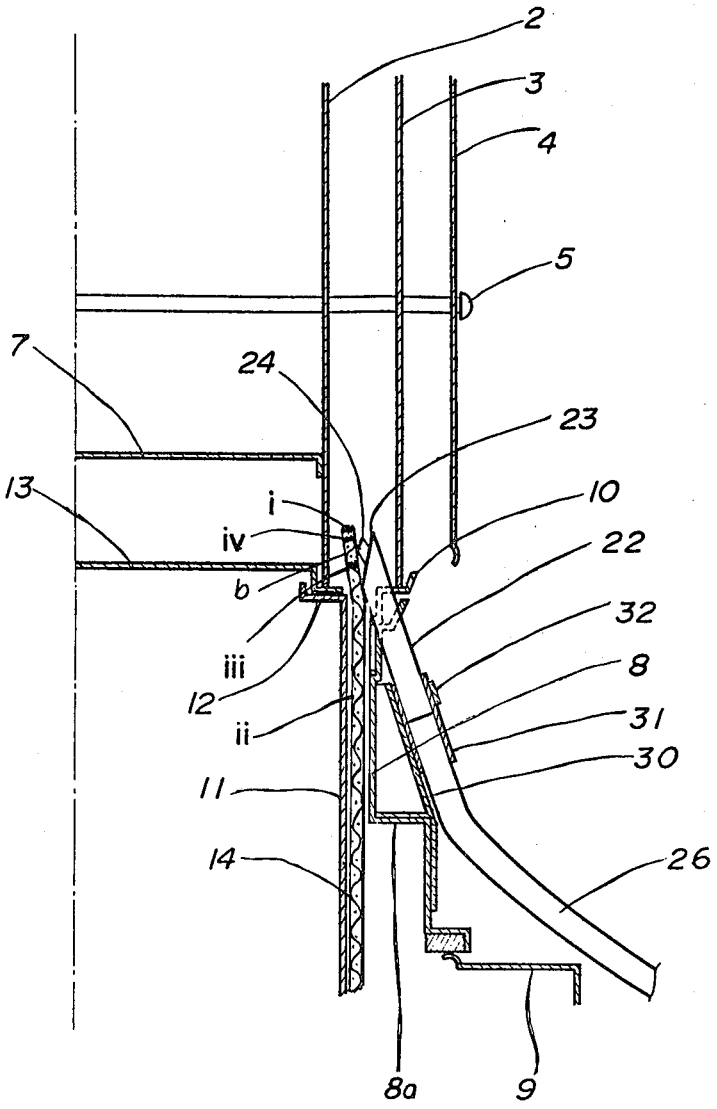
FIG. 2 is a cross-sectional view of the embodiment shown in FIG. 1.

A combustion wick 14 is held movable in a vertical direction within the wick cylinders 11 and 8 with its lowest end being dipped into oil in the oil container 9. It is obvious that the stove is adapted for use with paraffin, kerosene or other liquid fuels (referred to generally as "oil" hereafter). Returning to FIG. 1, a cylindrical wick holder 15 has an elongated rack 16 at a portion of its periphery to enable the wick 14 to move up and down, the rack 16 meshes with a pinion 18 at the tip of a wick adjust shaft 17. Revolution of a wick adjust knob 19 secured at the other end of the shaft 17 causes raising and lowering of the wick through the wick holder 15. The span of the movement of the wick is defined by the highest level i and the lowest level ii (extinguish position) as shown in FIG. 2. All that is necessary to move the wick 14 from the level i to the level ii is to rotate the knob 19 within a complete revolution (say, about 330°), thus providing convenience for the operator in moving up and down the wick by means of the knob 19. The above mentioned arrangement is not different from the conventional moving wick type oil stove.

The feature of the present invention resides in a new concept of introducing discharge ignition widely used for firing a variety of combustion gases into the field of wick type oil stoves. In addition, the present invention allows implementations of an ignitor assembly which offers superior advantages over the conventional ignitor as well as exhibiting operating performances (for example, firing speed and power consumption).

In the embodiment of the present invention, the ignitor assembly is powered with two serially connected 1.5 V batteries which are housed in a casing 20 at the back of the oil stove as seen from FIG. 1.

Figure 3:
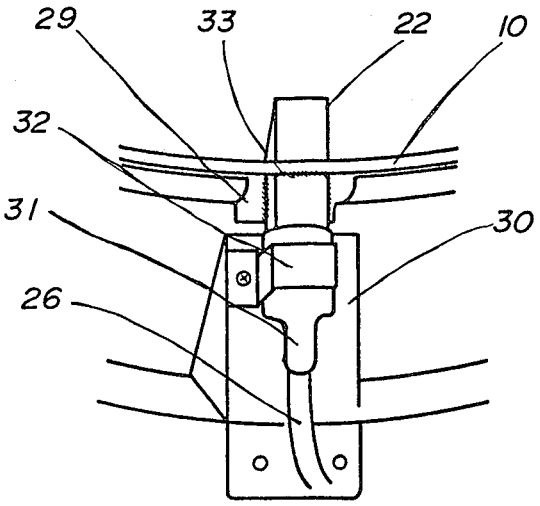
FIG. 3 is a detailed perspective view of the embodiment of the present invention.

As indicated in FIGS. 2 and 3, a discharge type ignitor plug 21, which plays an important role in the present invention, extends from outside the wick ring 10 into the space between the outer and inner shells 2 and 3. The discharge type ignitor plug 21 comprises a housing 22 set up of ceramic material of a rectangular configuration each side being of 7 mm to 10 mm long and having a discharge pin 24 having an overhang extending 2 mm - 3 mm from the center of an inclined surface 23 of the housing 22.

In FIG. 1, a high voltage generator 25 is adapted such that it may boost a total of 3 V DC voltage up to about 14 kV for supply to the ignitor plug 21. A cable 26 is routed from the high voltage generator 25 to the ignitor plug 21.

A boxlike microswitch 27 is provided for controlling when a high voltage is generated by the power supply and is disposed in the neighborhood of the wick adjust knob 19. Lead wires 28 are electrically connected between the power source, the high voltage generator 25 and the microswitch 27. It is preferable that the high voltage generator 25 be in proper location where it would not be heated to an elevated temperature during combustion of oil nor interfer with the installation of other components. For example, the high voltage generator 25 may be positioned in a recess in the back of the oil stobe.

When firing of the wick 14 is desirable, all that is necessary is to move up the wick 14 and initiate discharge toward the inner shell 2 grounded via the discharge pin 24. As a matter of fact, the wick is fired within 3 to 4 sec in the illustrated embodiment. This discharge ignition is, however, not expected to fire the wick so quickly and easily as spark discharge fires gas such as utility gas.

(Installation Of The Ignitor Plug 21)

In order that the ignitor plug 21 neither interfer with installation and removal of the burner 1 and the movement of the wick nor cause a dangerous situation, the ignitor plug 21 is inserted externally from the bottom and guided obliquely upwardly into a mounting hole 29 formed on the knob side of the wick ring 10 resting on the outer wick cylinder 8 as seen from FIGS. 1 to 3. Since the mounting hole 29 is formed inside the position adjacent the lowest end of the outer shell 3, it demands no special machining of the burner 1 and has no adverse effect on combustion. The housing 22 of the ignitor plug 21 is fixed to a step portion 8*a* of the wick cylinder 8 by use of an angle 30. An insulation tube 31 is used to cover the periphery of the joint between the ignitor plug 21 and the insulated cable 26. A plug pressure plate 32 urges the housing 22 of the ignitor plug 21 against the angle 30.

(Ignition Of The Wick 14)

When the wick 14 is below the level iii in FIG. 2, discharge from the discharge pin 24 takes place in the level b or the nearest position with respect to the inner shell 2. At this moment discharge does not strike the wick or fire it. When the upper end of the wick 14 is between the level iii and the level iv, sparks develop from a surface level flush with the upper end of the wick to the inner shell 2 while creeping across the upper end of the wick, so that energy occurring at this time permits firing of the wick. In other words, as the wick 14 is moved upwardly gradually upon revolution of the knob 19, the position where discharge take place is also elevated to make sure that sparks always run through the tip portion of the wick. This readily permits ignition due to the fact that the wick 14 is located near the insulation and discharge tends to escape from this region. When the wick 14 is above the level iv, discharge develops from the upper extreme of the pin. As the wick moves upwardly from the level iv to the level iv (say, about 2 mm apart) discharge takes place toward the inner shell 2 in such a manner as to creep across the upper extreme of the wick. If the wick 14 moves further, then discharge is permitted to run though the interior of the wick 14 with no effect on ignition. Since vapored oil settles about the bottom of a combustion chamber defined between the inner and outer shells 2 and 3 during combustion, it is in danger of coming into contact with the ignitor plug 21 and overflowing through the ignitor plug after liquefaction. Furthermore, air may be admitted to the burner via the mounting hole 29, thus resulting in improper combustion. To this end the mounting hole 29 is coated with an oilproof and heat proof sealant 33 to prevent a blot of oil and admission of air. A typical example of the sealant 33 is a coating consisting of a blend of zinc powders and epoxy resin, a silicon liquid gasket, etc.

(Control of Discharge Period)

The above mentioned high voltage generator 25 is switched on and off by the microswitch 27. Since it is preferable to determine power supply to the generator 25 mainly depending on the relative position of the wick 14, the microswitch 27 is adapted such that it senses via a cam plate 34 (FIG. 1) the rotating movement of the wick adjust knob 19 which is proportional to the position of the wick. Accordingly, the cam plate 34 and the microswitch 27 are correlated as shown in FIGS. 4(*a*) and 4(*b*), with the former showing the wick 14 in extinguish position and the latter showing the wick 14 in the course of moving upwardly. When the wick 14 is in extinguish position, an arm 27*a* of the microswitch 27 is in a recessed portion 34*a* of the cam plate 34 so that the switch 27 is in off position and the high voltage generator 25 is not enabled. As the knob 19 is rotated in the direction of the arrow to hoist the wick 14, the cam plate 34 also rotates and the non-recessed periphery 34*b* of the cam plate 34 forces the switch arm 27*a* upwardly to an on position and energizes the generator 25.

Figure 5:
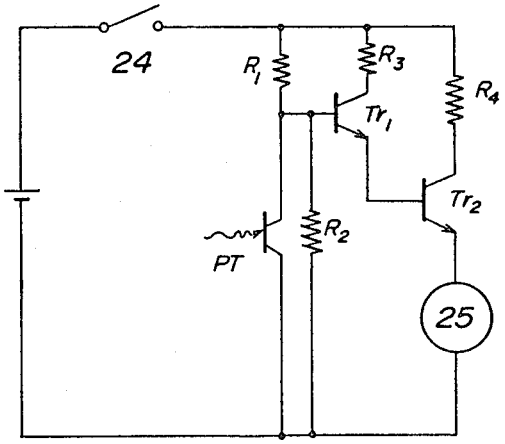
FIG. 5 is a circuit diagram of a firing circuit.

Switching on the microswitch 27 is determined optionally by the position of the recessed portion 34*a* of the cam plate 34. In the illustrated embodiment, the switch is turned on when the wick 14 is slightly above the lowest level and kept in on position after the wick is further raised from that position. With the wick 14 reaching the ignition position of FIG. 2, ignition is effected in the above described manner. The power supply to the high voltage generator 25 continues until ignition is completed and discontinues immediately upon completion of ignition. To this end a control circuit as shown in FIG. 5 is incorporated into the microswitch assembly 27. In FIG. 5, the control circuit includes a set of resistors $R_1$–$R_4$, a pair of transistors $Tr_1$ and $Tr_2$ and a light sensitive element PT which is rendered on upon incident light such as a photo transistor. This element PT is secured on one end of a light receiving tube 35 resting on the wick ring 10 as best shown in FIGS. 6(*a*) and 6(*b*). It is clear from FIGS. 6(*a*) and 6(*b*) that one end of the light receiving tube 35 of ceramic material or the like extends from the wick ring 10 into the combustion chamber between the inner and outer shells 2 and 3 and the remaining end thereof extends outside the ring 10. The tube 35 is kept about 3 cm away from the ignitor plug 21 along the ring 10 so that it can not receive a given quantity of light unless the flame stands in a portion of the wick 14 facing against a window in the tube 35. To avoid thermal influence of the flame, the element PT is secured via a thermal insulator 36 on an extended end of the tube 35.

When the knob 19 is rotated clockwise, the microswitch 24 is turned on as stated previously. Current flows through the high resistors $R_1$ and $R_2$, turning on the transistors $Tr_1$ and $Tr_2$ and supplying the high voltage generator 25 with power. The result is that discharge takes place to fire the portion of the wick facing against the discharge pin 24. Discharge continues since light originating from the discharge and the flame at the fired portion of the wick is not incident on the light receiving tube 35.

When the flame at the wick 14 spreads sidewardly gradually and reaches the window in the light receiving tube 35, the light receiving element PT becomes operable to turn off the transistors Tr1 and Tr2 and discontinue the power supply to the high voltage generator 25.

Therefore the discharge discontinues. Since the light receiving element PT is in the on position while the flame appears at the wick 14, discharge is not effected again. However, in the event that the flame disappears due to any reason with the wick 14 remaining at combustion position, discharge is effected again in an attempt to fire the wick. When it is desired to extinguish the wick by moving downwardly the wick, no discharge is effected whether the element PT is in off or on position, because of the microswitch 27 in off position. It is preferable that the light receiving tube 35 resting on the wick ring 10 be covered with a sealant similar to the sealant 33 overlaying the ignitor plug 21.

As noted earlier, the element PT is prevented from becoming faulty due to discharge sparks or unstable flame at the wick 14 to thereby insure stable ignition as long as the light receiving tube 35 is kept away from the ignitor plug 21. In other words, provided that the tube 35 is held in the neighborhood of the ignitor plug 21, the element PT chatters and causes unstable discharge due to discharge sparks or momentarily fired flame. On the contrary, the present invention provides stable and complete ignition of the wick 14 and discontinues discharge when the flame is strong enough not to be extinguished voluntarily.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An ignitor assembly for oil stoves comprising:

an electric power supply;

an ignitor plug held in alignment with an exposed portion of a wick for firing the wick through the utilization of discharge originated from the electric power supply to the ignitor plug; and a flame sensor disposed at a predetermined distance from the ignitor plug and in alignment with the exposed portion of the wick, said flame sensor element terminating the supply of electric power to said ignitor plug after combustion of said wick and reestablishing the supply of electric power to the ignitor plug if said wick is inadvertently extinguished while being in a predetermined operative position.

2. An ignitor assembly as set forth in claim 1 wherein said flame sensor includes a photo transistor responsive to light originating from a flame at the wick.

3. An ignitor assembly as set forth in claim 2 wherein said flame sensor operates to discontinue discharge of said ignitor when the flame is strong enough not to be extinguished voluntarily.

4. An ignitor assembly as set forth in claim 1 wherein said ignitor plug comprises a discharge pin responsive to a high voltage generated in an electrical ignitor circuit.

5. An ignitor assembly as set for in claim 4 wherein said electric power supply is DC and said ignitor circuit includes a booster for boosting the battery voltage of said electric power supply.

6. An ignitor assembly for a fuel burning stove having a wick movably mounted between an operative position wherein said wick may be ignited to consume fuel and provide heat and an inoperative position wherein said wick is extinguished comprising:

an ignitor plug being positioned in alignment with said wick when said wick is in said operative position;

an electric power supply for selectively supplying power to said ignitor plug to fire said wick when said wick is in said operative position; and a flame sensor disposed at a predetermined distance from the ignitor plug and being in alignment with said wick when said wick is in said operative position;

said flame sensor terminating the supply of electric power to said ignitor plug after combustion of said wick and reestablishing the supply of electric power to the ignitor plug if said wick is inadvertently extinguished while being in a predetermined operative position.

7. An ignitor assembly according to claim 6, and further including a wick adjusting knob for manually moving said wick between said operative and inoperative positions and a microswitch operatively connected to said electric power supply, said wick adjusting knob including a cam surface operatively connected to said microswitch for actuating said microswitch and said ignitor when said wick is moved to an operative position and for deactuating said microswitch when said wick is moved to an inoperative position.

8. An ignitor assembly according to claim 6, wherein said ignitor plug comprises a discharge pin responsive to a high voltage generated in an ignitor circuit and a housing.

9. An ignitor assembly according to claim 6, wherein said electric power supply is DC and said ignitor circuit includes a booster for boosting the battery voltage of said electric power supply.

* * * * *